US005880623A

United States Patent [19]

Levinson

[11] Patent Number: 5,880,623

[45] Date of Patent: Mar. 9, 1999

[54] POWER SUPPLY CONTROL TECHNIQUES FOR FET CIRCUITS

[75] Inventor: Roger Levinson, Sunnyvale, Calif.

[73] Assignee: Exar Corporation, Fremont, Calif.

[21] Appl. No.: 808,822

[22] Filed: Feb. 28, 1997

[51] Int. Cl.[6] ..... G05F 1/10

[52] U.S. Cl. ..... 327/540; 327/530; 327/538; 327/546; 326/33

[58] Field of Search ..... 327/530, 538, 327/540, 541, 544, 546, 555, 416, 404, 427; 326/33, 31

[56] References Cited

U.S. PATENT DOCUMENTS 4,555,642 11/1985 Morales ..... 327/541
4,797,580 1/1989 Saunter ..... 307/451
5,274,601 12/1993 Kawahara et al. ..... 365/230.06
5,583,457 12/1996 Horiguchi et al. ..... 327/544
5,696,465 12/1997 Ishizuka ..... 327/544

*Primary Examiner*—Timothy P. Callahan
*Assistant Examiner*—Jung Ho Kim
*Attorney, Agent, or Firm*—Townsend and Townsend and Crew LLP

[57] ABSTRACT

Method and circuitry for power control in integrated circuits using field effect transistor (FET) technology are disclosed. According to the present invention, for each circuit block that is biased by the power supply voltage a dedicated level shifter is inserted between the block and the power supply. In one embodiment, a switch is also coupled in parallel to the level shifter. The switch is closed when a low external power supply voltage is applied, and opened when a higher power supply voltage is applied. A second embodiment removes the switch and adds a bias generator that supplies a bias voltage to each level shifter.

12 Claims, 3 Drawing Sheets

POWER SUPPLY CONTROL TECHNIQUES FOR FET CIRCUITS

BACKGROUND OF THE INVENTION

The present invention relates in general to integrated circuits using field effect transistor (FET) technology, and in particular to techniques for improving reliability and power consumption of such circuits.

Significantly higher degrees of integration have been made possible by the continuous shrinking of dimensions in semiconductor processing. As the FET processing technology moves well into the sub-micron regime, secondary phenomena such as short channel effects and hot carrier degradation become more pronounced. At the same time, there has also been a market driven demand for integrated circuits that operate at more than one power supply levels. Shifting the power supply voltage of a FET circuit from, for example, 3 volts to 5 volts, often exacerbates problems caused by such secondary effects.

Hot electron injection is a secondary effect that degrades circuit performance by causing shifts in the threshold voltage of FETs and/or their transconductance value. Hot electron injection in FETs is typically at its worst case when the drain to source voltage of the transistor is high, and its gate voltage is halfway in between. In digital circuitry such worst case conditions occur only during very short transition periods from one logic level to another. However, analog FET circuitry, and especially CMOS inverters, remain in the maximum hot electron condition a considerable percentage of time. Further, the increased source-to-drain voltage when switching from 3 volt supply voltage to 5 volt supply voltage intensifies the undesired effects.

The capability to integrate more and more active devices onto a single chip has also resulted in substantially larger power consumption and increase in operating temperatures of integrated circuits. In particular, in analog FET circuitry where transistors operate in their linear region for a larger percentage of time, significantly larger amounts of current are dissipated. Power consumption and temperature are also factors that increase proportionally with the power supply voltage.

One way to reduce hot electron injection as well as excessive power consumption and temperature, is to operate FET circuitry with reduced drain-to-source voltages. Thus, when the power supply voltage for a device is switched from, for example, 3 volts to 5 volts, a global on-chip voltage regulator can be used to maintain the lower operating voltages internal to the device. While such a voltage regulator does help to reduce hot electron injection and power consumption, it may not be as effective or practical. For example, a large digital-to-analog converter (DAC) or an analog-to-digital converter (ADC) that uses analog FET inverters, would require an extremely robust voltage regulator to handle all of the transients from all of the circuitry it drives. Such a voltage regulator would be very large, taking valuable silicon area and may still not meet the requirements for larger analog circuits.

Therefore, there is a need for techniques that can help reduce power consumption and temperature as well as secondary effects such as hot electron injection in FET circuitry.

SUMMARY OF THE INVENTION

The present invention provides a method and circuitry for substantially reducing power consumption and hot electron injection in FET circuitry. Broadly, according to this invention individual circuit elements and blocks are provided with dedicated switchable power control circuitry. Various methods for controlling the power control circuitry are also disclosed.

Accordingly, in one embodiment, the present invention provides an integrated circuit using field effect transistors (FETs) including a plurality of circuit blocks having FETs coupled between a first node for receiving a power supply voltage and a second node for receiving ground. The integrated circuit further includes a plurality of level shift elements respectively coupled between a source of the power supply voltage and the first node of each one of the plurality of circuit blocks, and a plurality of switch elements respectively coupled between the source of the power supply voltage and the first node, wherein when a switch element is closed, a voltage level substantially equal to a level of the power supply voltage is supplied to the corresponding circuit block, and when the switch is closed a voltage level different than the level of the power supply voltage is supplied to the corresponding circuit block through the level shift element.

In another embodiment, the present invention provides an integrated circuit using field effect transistors (FETs) including a plurality of circuit blocks having FETs coupled between a first node for receiving a power supply voltage and a second node for receiving ground. The integrated circuit further includes a plurality of level shift elements respectively coupled between a source of the power supply voltage and the first node of each one of the plurality of circuit blocks, and a bias generator having an output coupled to a control input of each one of the plurality of level shift elements, wherein the bias generator operates to maintain a substantially constant current flowing through each one of the plurality of circuit blocks under varying power supply voltages.

A better understanding of the nature and advantages of the present invention may be had with reference to the detailed description and the drawings below.

DESCRIPTION OF THE PREFERRED EMBODIMENT

Figure 1:
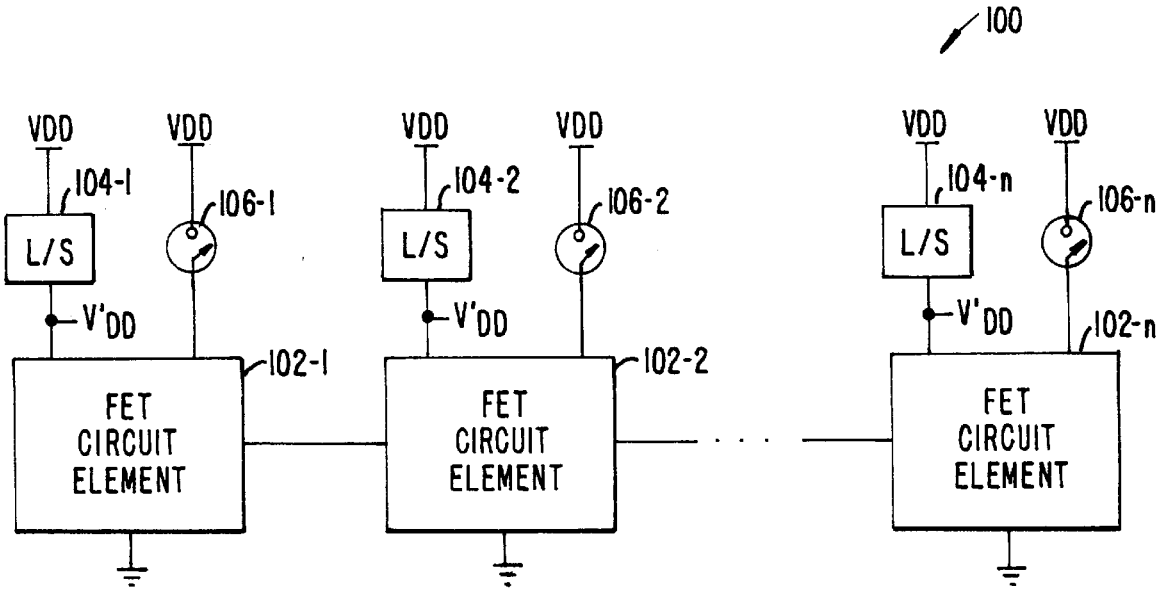
FIG. 1 shows a simplified block diagram of the power control circuit according to the present invention.

FIG. 1 is a simplified block diagram showing the power control technique of the present invention. An exemplary field effect transistor (FET) circuit 100 is shown as being made up of several FET circuit elements 102-1 to **102-*n*. FET circuit elements 102 can be any type of FET circuit where the bias current depends on the power supply voltage. A CMOS inverter when used as an analog cell, or a transconductance element $G_m$ of the type used in $G_m$-C filters are good examples of such FET circuit elements. Further, it is to be understood that the serial connection of FET circuit elements 102 as shown in FIG. 1 is over simplified and for illustrative purposes only. Circuit 100 may be made up of circuit elements 102** as well as other types of circuit components that are interconnected in a variety of differing networks.

Referring back to FIG. 1, each FET circuit element 102 connects to the power supply $V_{DD}$ via a switch 106 as well as a level shift circuit 104. When circuit 100 is to operate with a lower $V_{DD}$ level of, for example, 3 volts, all switches 106 are closed tying $V_{DD}$ directly to each FET circuit element 102. When a higher voltage of, for example, 5 volts is connected to $V_{DD}$, switches 106 are opened and $V_{DD}$ is level shifted for each element 102 down to $V_{DD}'$ by a respective level shift circuit 104. The level of $V_{DD}'$ can be adjusted to maintain the same power supply voltage level for each circuit element 102 under both $V_{DD}$ conditions. Note that a closed switch 106 provides a direct connection to $V_{DD}$, bypassing level shift 104. Thus, the same biasing conditions are present under the higher $V_{DD}$ level as under the lower $V_{DD}$ level. This minimizes any increase in power consumption and lowers the occurrence of hot electron injection as the circuit switches to a higher $V_{DD}$ level. The present invention realizes these advantages without requiring a large and costly voltage regulator. Each level shift circuit 104 drives a small circuit element and thus can be implemented using substantially smaller circuitry.

Figure 2:
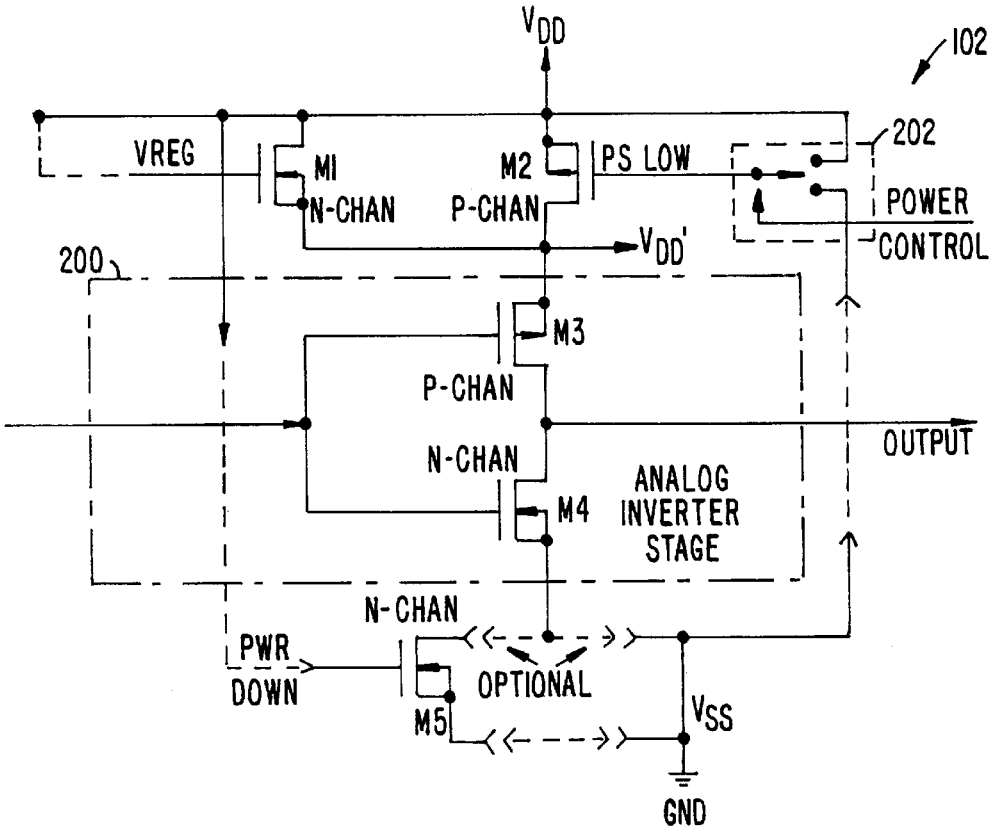
FIG. 2 shows a circuit schematic for the power control circuit of FIG. 1 using a CMOS inverter as an example.

FIG. 2 shows a simplified circuit schematic for FET circuit element 102 using a CMOS inverter as an example. The CMOS inverter is commonly used as an analog cell in data acquisition circuitry such as flash converters. P-channel FET M3 and N-channel FET M4 form CMOS inverter 200. Inverter 200 is connected to the power supply $V_{DD}$ via a P-channel FET M2 whose gate terminal is connected to a switch 202. Switch 202 connects M2's gate terminal to either a high voltage level (e.g., $V_{DD}$) or a low voltage level (e.g., ground). A level shift N-channel FET M1 also connects inverter 200 to $V_{DD}$, with its gate coupled to a bias voltage Vreg. Thus, FETs M1 and M2 connect in parallel and between the source terminal of P-channel FET M3 (node $V_{DD}'$) and $V_{DD}$. The circuit also provides the option of coupling the source terminal of N-channel FET M4 either directly to ground, or via another N-channel FET M5.

P-channel FET M2 provides the user control for the power supply mode of operation. FET M2 is turned OFF or ON depending on which power supply level is selected. The gate terminal of M2 receives either ground or $V_{DD}$ in response to the power control signal PC. When switch 202 is tied to ground, FET M2 is turned ON essentially shorting $V_{DD}'$ to $V_{DD}$. Under such a condition, the relatively small on-resistance of M2 shunts M1. The voltage level at $V_{DD}'$ is, therefore, actually slightly below that of $V_{DD}$. This condition represents the circuit's low voltage state, i.e., the state where the user $V_{DD}$ is already low (e.g., 3 volts), and does not require further reduction.

For the higher (e.g., 5 volt) $V_{DD}$ operation, PC connects switch 202 to a high voltage (e.g., power supply voltage $V_{DD}$), turning OFF M2. Under this condition, the voltage level at $V_{DD}'$ is equal to $V_{DD}$ minus the drain-to-source voltage of M1. Assuming that the gate terminal of M1 (Vreg) connects, in one embodiment, to the power supply terminal $V_{DD}$, M1 acts essentially as a MOS diode. The diode voltage drop provides the level shift from the higher $V_{DD}$ voltage level to a lower $V_{DD}'$ level. Given typical values under an exemplary 5 volt $V_{DD}$, the voltage level at $V_{DD}'$ would equal approximately 3.8 volts or less. Accordingly, M1 operates to reduce the maximum source-to-drain voltage of the inverter transistors. This reduction in voltage reduces power consumption and hot electron injection.

The gate terminals of M1 and M2 can be controlled in a number of ways. FIG. 2 shows the various options by the use of dotted lines. For example, the gate voltage of M1 can be set by an optional bias voltage, instead of the diode-connected option discussed above. Such an embodiment is further described in detail in connection with FIG. 3. Also, the control signal for switch 202 can be either supplied directly by the user (e.g., though an external pin), or by an on-chip automatic power supply level detection circuit.

The primary function of the optional transistor M5 is to balance inverter 200. The on-resistance of FETs M1 and M2 act as degeneration resistors for P-channel FET M3. Adding such a degeneration to the P-channel FET only, unbalances the M3/M4 complementary inverter circuit. For a balanced inverter operation, either N-channel M4 can have similar degeneration, or the size ratios of M3 and M4 can be adjusted to compensate for the imbalance. Connecting transistor M5 to the source terminal of FET M4, provides the balancing degeneration for the N-channel half of the inverter. M5 can also act as a power down switch for the circuit.

More specifically, when M2 is OFF, the effective source-to-drain impedance of M1 sets the source degeneration for P-channel FET M3 of the inverter circuit. Under this condition, the gate voltage at M1 determines the source to drain impedance. This value is defined as:

$$Z = \frac{1}{gm}$$

where: Z is the source to drain impedance and gm is the FET's transconductance.

To maintain the same source degeneration in either mode of operation, the on-resistance ($R_{ON}$) of M2 is designed to be equal to the source-to-drain impedance of M1. This avoids different values of source degeneration for the N-channel half of the inverter when switching from one power supply voltage level to another.

The on-resistance of M5 is also designed to be equal to that of M2's (or M1's impedance). Alternatively, if M5 is not included (i.e., M4 connects directly to ground), the ratio of transistor sizes for M3 and M4 is designed such that the transconductance (gm) of M4 is the same as that of M3's including M3's degeneration. Meeting these requirements insures the source degeneration for N-channel FET M4 matches the degeneration for P-channel FET M3. This results in a fully balanced inverter circuit M3/M4.

Figure 3:
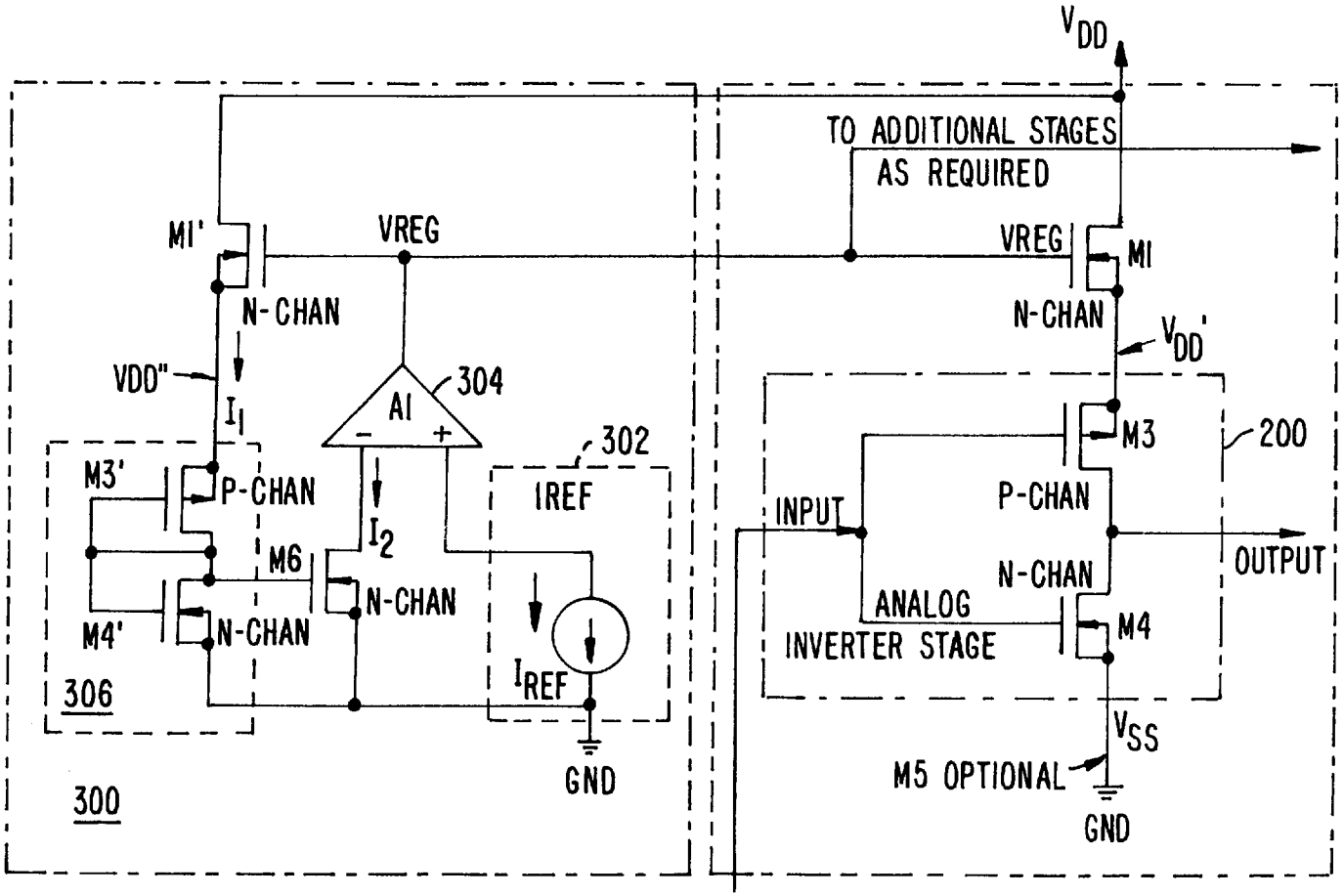
FIG. 3 shows another embodiment for the power control circuit of the present invention having a constant current operation.

Another embodiment for the power control circuit according to the present invention is shown in FIG. 3. The CMOS inverter is also used in this embodiment as an example to illustrate the operation of the circuit. The same reference numerals are used in FIG. 3 to identify the same circuit elements as in FIG. 2. This embodiment includes inverter 200 and level shift N-channel FET M1. A bias generator 300 supplies bias voltage Vreg to the gate terminal of FET M1. Vreg thus controls the amount of current flowing through the M3/M4 inverter. Bias generator 300 operates to produce the desired voltage level at $V_{DD}'$ regardless of the level of the external supply voltage $V_{DD}$. Bias generator 300 also enables the circuit to track variations in manufacturing process and operating temperature. The operation of the circuit is described hereinafter.

The on-resistance of FETs M3 and M4 can vary as much as 30% to 40% over process variations. To maintain a constant current flowing through M3 and M4, bias generator 300 is designed such that variations in M3 and M4 are tracked over temperature and process. To accomplish this, bias generator 300 includes a CMOS inverter that is essentially a replica of inverter 200 to control the value of Vreg.

Using the identical components that are made of the same material and follow the same manufacturing process, ensures close tracking over process and temperature variations.

Accordingly, bias generator 300 includes a constant current source 302 which provides a reference current $I_{Ref}$ that is independent of the power supply voltage. Reference current $I_{Ref}$ can be generated by a number of different known techniques such as Zener diode (for low accuracy) or Band-Gap circuit (for high accuracy). $I_{Ref}$ is applied to a positive input of an operational amplifier (opamp) 304 which operates as a transimpedance amplifier. That is, the voltage output of opamp 304 is determined by the difference of the currents at its two input terminals. The current $I_2$ at the negative terminal of opamp 304 is set by an N-channel FET M6 and the bias voltage appearing at the gate terminal of M6. The gate voltage for M6 is supplied by inverter 306 whose transistors M3' and M4' replicate M3 and M4 of inverter 200. The output of inverter 306 is connected to its input to emulate an analog inverter amplifier in its balanced condition. The output of opamp 304 sets the bias voltage to the gate of N-channel FET M1' that replicates M1. M1' controls the current $I_1$ that flows through inverter 306.

Transistors M4' and M6 act as a current mirror. The current $I_2$ at the negative input of opamp 304 is mirrored in proportion to the channel areas of the two FETs M4' and M6. This connection between opamp 304 and inverter 306 creates a closed loop constant current source. The actual current represented by $I_2$, reflects the values of $I_{Ref}$ as well as the channel areas of M4' and M6. This yields a voltage at the output of opamp 304 that fixes the value of $I_2$ (through $I_1$) to equal that of $I_{Ref}$. As a result, the source terminal of FET M1' ($V_{DD}$") is set to a regulated voltage level regardless of the externally supplied $V_{DD}$ level.

As shown in FIG. 3, the output of opamp 304 also drives the gate terminal of FET M1. As this is the same voltage that drives the gate terminal of M1', given the same transistor sizes, the current flow through M1 (and thus the inverter M3/M4) is equal to that flowing through M1'. As a result, the voltage level at $V_{DD}$" of inverter 306 and $V_{DD}$' of inverter 200 are equalized. Since the voltage at $V_{DD}$" is fixed at a desired level below $V_{DD}$ regardless of changes in $V_{DD}$, $V_{DD}$' is also well regulated at the same level. Thus, power consumption remains substantially constant as the external power supply voltage for the circuit switches from, for example, 3 volts to 5 volts. Furthermore, as transistors M1', M3' and M4' replicate M1, M3, and M4, respectively, the circuit power consumption is made insensitive to process and temperature variations.

According to a preferred embodiment of this invention, one bias generator 300 drives a number of level shift transistors M1. That is, bias generator 300 need not be replicated for each circuit element 102 (FIG. 1). Since bias generator 300 provides a bias voltage that is applied to gate terminals of level shift transistors M1, it has practically zero current load. A single Vreg output can therefore drive a large number of level shift transistors. Also, a balancing degeneration FET M5 may also be used with the circuit of this embodiment.

Figure 4:
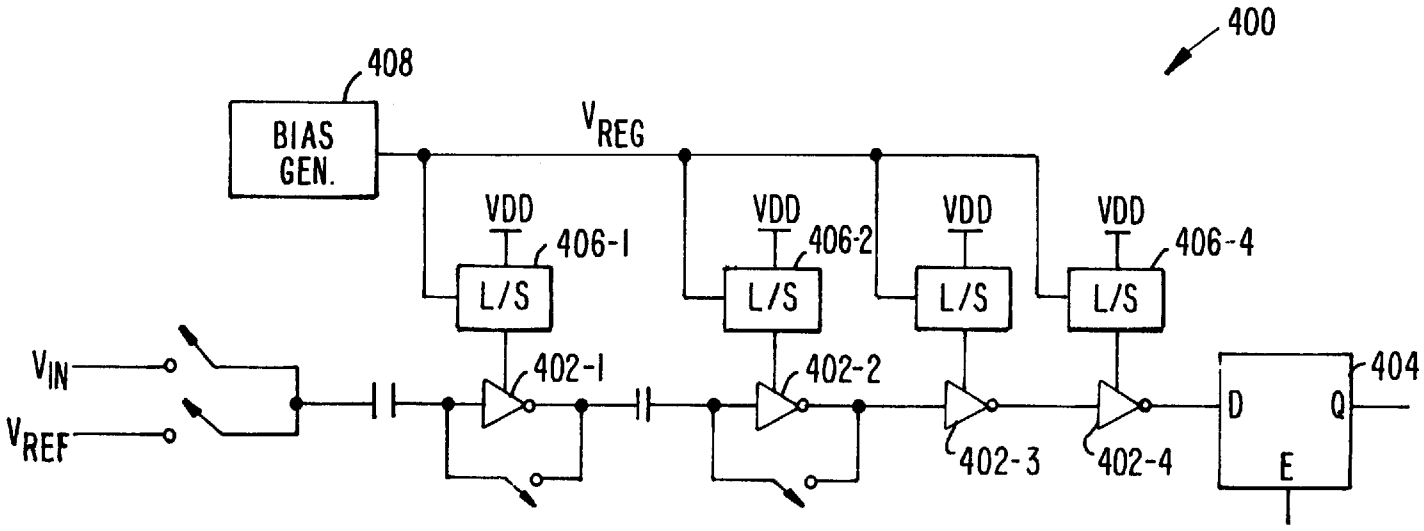
FIG. 4 shows a comparator using inverters as analog cells according to the present invention.

FIG. 4 shows an example of the type of circuit that may use the power control techniques of the present invention. FIG. 4 shows an exemplary analog comparator 400 of the type commonly used in flash converter circuits. Comparator 400 uses analog inverters 402-1 to 402-4 along with a network of switches and capacitors and a D type flip flop 404 to implement the compare function between Vin and Vref. According to this invention, instead of connecting inverters 402 to $V_{DD}$ directly, each inverter 402 couples to the external $V_{DD}$ via a level shift transistor 406 (M1 in FIG. 3). A single bias generator 408 (300 in FIG. 3) generates Vreg that drives the gate terminal of all level shift transistors 406. Thus, the FETs inside analog cells 402-1 to 402-4 in this circuit operate with a reduced drain-to-source voltage. This not only reduces the power consumption of the circuit, it minimizes the undesirable effects of hot electron injection. The power consumption remains low regardless of the voltage level at the power supply node $V_{DD}$. Furthermore, the technique of the present invention minimizes circuit performance degradation caused by process and temperature variations.

In conclusion, the present invention provides efficient power control methods and circuitry to reduce power consumption and hot electron injection in FET circuits. While the above is a complete description of the preferred embodiment of the present invention, it is possible to use various alternatives, modifications and equivalents. Therefore, the scope of the present invention should be determined not with reference to the above description but should, instead, be determined with reference to the appended claims, along with their full scope of equivalents.

What is claimed is:

1. An integrated circuit using field effect transistor (FET) technology, comprising:

a plurality of circuit blocks having FETs coupled between a first node for receiving a power supply voltage and a second node for receiving ground;

a plurality of level shift elements each one coupled between a source of the power supply voltage and said first node of a respective one of said plurality of circuit blocks; and a plurality of switch elements each one respectively coupled between said source of the power supply voltage and said first node, and operating in response to a control signal, wherein, said control signal closes or opens said plurality of switch elements depending on a level of voltage applied to said source of the power supply voltage thereby maintaining a substantially constant voltage at said first node.

2. The integrated circuit of claim 1 wherein each one of said plurality of level shift elements comprises a FET having a first source/drain terminal coupled to the source of the power supply voltage, a second source/drain terminal coupled to said first node, and a gate terminal.

3. The integrated circuit of claim 2 wherein said FET is an N-channel FET having its gate terminal coupled to a reference voltage.

4. The integrated circuit of claim 2 wherein each one of said plurality of switch elements comprises a FET having a first source/drain terminal coupled to the source of the power supply voltage, a second source/drain terminal coupled to said first node, and a gate terminal.

5. The integrated circuit of claim 4 wherein said FET of said switch element is a P-channel FET having its gate terminal coupled to a switch that connects said P-channel FET gate terminal to one of a high voltage level and low voltage level.

6. The integrated circuit of claim 4 further comprising a plurality of degeneration FETs each one respectively coupled between said second node of each of said plurality of circuit blocks and ground.

7. The integrated circuit of claim 4 wherein each one of said plurality of circuit blocks comprises an inverter having a P-channel FET coupled to an N-channel FET.

8. An integrated circuit using field effect transistor (FET) technology, comprising:

a plurality of circuit blocks having FETs coupled between a first node for receiving a power supply voltage and a second node for receiving ground;

a plurality of level shift elements each one respectively coupled between a source of the power supply voltage and said first node of each one of said plurality of circuit blocks; and a bias generator having an output coupled to a control input of each one of said plurality of level shift elements, wherein, said bias generator comprises:

a constant current source generating a first current $I_{Ref}$;

an operational amplifier having a first input terminal coupled to said constant current source, a second input terminal and an output terminal coupled to said output of said bias generator;

a replica circuit block having FETs replicating said FETs in one of said plurality of circuit blocks;

a replica level shift element coupling said replica circuit block to said source of the power supply voltage, said replica level shift element having a FET with a gate terminal coupled to said output terminal of said operational amplifier; and a current-mirror FET having a gate terminal coupled to a diode-connected FET in said replica circuit block; and a source/drain terminal coupled to said second input of said operational amplifier.

9. The integrated circuit of claim 8 wherein each one of said plurality of level shift elements comprises a FET having a first source/drain terminal coupled to the source of the power supply voltage, a second source/drain terminal coupled to said first node, and a gate terminal.

10. The integrated circuit of claim 8 wherein each one of said plurality of circuit blocks comprises an inverter having a P-channel FET coupled to an N-channel FET.

11. A method for controlling power level in a field effect transistor (FET) circuit having a plurality of power supply biased circuit blocks, comprising the steps of:

inserting a level shift element between the power supply and each one of the plurality of power supply biased circuit blocks;

coupling a switch in parallel to each level shift element; and maintaining a substantially constant power supply voltage for said plurality of power supply biased circuit blocks by:

closing said switch to provide for a substantially direct coupling between each one of said plurality of power supply biased circuit blocks and the power supply, in a first mode of operation wherein a first voltage is applied to the power supply; and opening said switch to supply a level shifted supply voltage to each one of said plurality of power supply biased circuit blocks via said level shift element, in a second mode of operation wherein a second voltage higher than said first voltage is applied to the power supply.

12. The integrated circuit of claim 1 wherein in a first mode of operation when a first voltage is applied to the source of the power supply voltage, said control signal closes said plurality of switch elements to directly couple the first voltage to the first node, and in a second mode of operation when a second voltage higher than said first voltage is applied to the source of the power supply voltage, said control signal opens said plurality of switches to couple a level shifted second voltage to the first node.

* * * * *